US005281761A

United States Patent [19]

Woo et al.

[11] Patent Number: 5,281,761

[45] Date of Patent: Jan. 25, 1994

[54] GROUNDING PIPE/WATER PIPE WITH COMPRESSION CONNECTORS

[75] Inventors: Kenneth Woo, Manchester; H. Thomas Nelson, Bedford, both of N.H.

[73] Assignee: Burndy Corporation, Norwalk, Conn.

[21] Appl. No.: 840,525

[22] Filed: Feb. 25, 1992

[51] Int. Cl.[5] ..... H01R 4/66

[52] U.S. Cl. ..... 174/78; 439/100; 439/777

[58] Field of Search ..... 174/78, 51; 439/777, 439/775, 785, 100, 812, 800, 791, 799

[56] References Cited

U.S. PATENT DOCUMENTS

| | | | |
|---|---|---|---|
| 1,788,309 | 7/1929 | Buchanan | 248/66 |
| 1,793,911 | 2/1931 | Dann | 439/777 |
| 1,864,292 | 6/1932 | Buchanan | 439/777 |
| 1,897,186 | 2/1933 | Buchanan | 439/100 |
| 1,976,769 | 10/1934 | Borden | 439/777 |
| 1,986,028 | 1/1935 | Terry | 439/100 |
| 2,038,436 | 4/1936 | Mangin | 439/777 |
| 2,156,965 | 9/1937 | Borden | 439/777 |
| 3,492,625 | 3/1968 | Bromberg | 439/100 |
| 4,106,832 | 8/1978 | Burns | 439/100 |
| 4,159,859 | 7/1979 | Shemtov | 439/100 |
| 4,189,198 | 2/1980 | Reichman | 439/100 |
| 4,248,490 | 2/1981 | Bachle | 439/98 |
| 4,257,658 | 3/1981 | Hammond et al. | 174/78 |
| 4,623,204 | 2/1981 | Auclair | 439/100 |
| 4,626,051 | 12/1986 | Franks, Jr. | 439/100 |

*Primary Examiner*—Morris H. Nimmo

*Attorney, Agent, or Firm*—Burtsell J. Kearns; Mitchell B. Wasson; Martin P. Hoffman

[57] ABSTRACT

A grounding clamp for permitting the grounding of an electrical cable provided with a 2-hole compression connector allowing the grounding of this cable to a metallic pipe. A mechanical clamp provided with a saddle portion and one or more U-bolts is mounted to the pipe. The mechanical clamp is provided with a mounting pad onto which the compression conductor is also mounted. A connection system is provided between the mounting pad and the compression lug allowing the electrical cable to be angled at different directions with respect to the metallic pipe.

12 Claims, 4 Drawing Sheets

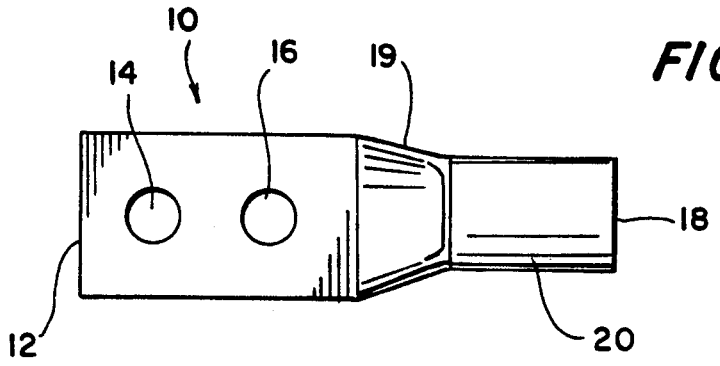
FIG. 1A.
FIG. 1B.
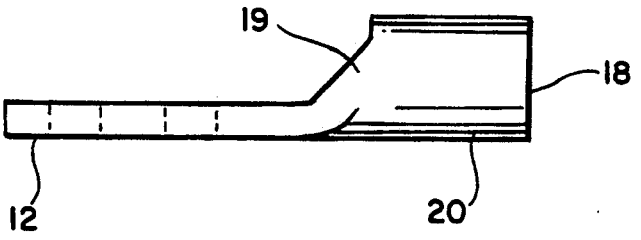

GROUNDING PIPE/WATER PIPE WITH COMPRESSION CONNECTORS

BACKGROUND OF THE INVENTION

It is well known in the art to protect a house, building or other structure from a fire hazard by establishing a connection between the electrical system in the particular edifice and ground. In this manner, the edifice is protected from stray current, short circuits or similar potentially dangerous situations. One particularly effective manner of connecting the electrical system to ground will utilize the employment of a metallic water or similar pipe as the ground connection.

Typical prior art systems and methods for connecting an electrical system to a metallic pipe are shown in U.S. Pat. Nos. 1,864,292; 1,897,186; 1,899,309 all issued to Buchanan; U.S. Pat. No. 1,793,911 issued to Dann and U.S. Pat. No. 2,156,965 issued to Borden. The patent to Borden describes a ground fitting for connecting a ground wire to a waterpipe or other earth electrode. A body member 17 and a ground clamp are provided to connect the ground wire either in parallel to the waterpipe or transverse to the waterpipe. The patent to Dann discusses a ground fitting for an electrical system including a conduit-supporting member provided with a socket adapted to receive one end of a conduit, a clamp adapted to grip a waterpipe or other grounding medium, and a means for pivotally connecting the conduit-supporting member and the clamp together. The patents to Buchanan describe a ground fitting consisting of two members, one of which is anchored to an electrical conduit, and the other of which is clamped to a grounded pipe. Particularly with respect to Buchanan '186, it is noted that these two members can be assembled into a predetermined or limited number of angular positions with respect to one another.

However, it is noted that these prior art references do not utilize a compression connector, housing an electrical cable to be grounded. Additionally, none of these references show a system in which mounting pads are provided directly on the compression connector and an arcuate seat used to connect one or more U-shaped clamping bolts around a metallic pipe in order to allow the electrical cable to be provided at different angles with respect to the metallic pipe.

SUMMARY OF THE INVENTION

These and other liabilities of the prior art are overcome by the present invention which grounds an electrical system including a conduit or cable to a ground electrode, such as a metallic utility pipe carrying water or the like. The electrical cable is crimped into a compression connector provided with a mounting pad. This mounting pad is aligned with a mounting pad provided in conjunction with an arcuate saddle. The metallic pipe is seated against the saddle, and one or more U-bolts are provided around the metallic pipe and are connected to both ends of the saddle. Holes are provided at various locations on the mounting pad of the saddle which would allow the compression connector to be provided at different angles with respect to the pipe.

The above and other objects, features and advantages of the present invention will become apparent from the following description and the appended claims, taken in conjunction with the accompanying drawings.

BRIEF DESCRIPTION OF THE DRAWINGS

FIG. 1A is a perspective view of a compression connector used in the present invention;

FIG. 1B is a side view of the compression connector used in the present invention;

DETAILED DESCRIPTION OF THE INVENTION

Figure 2:
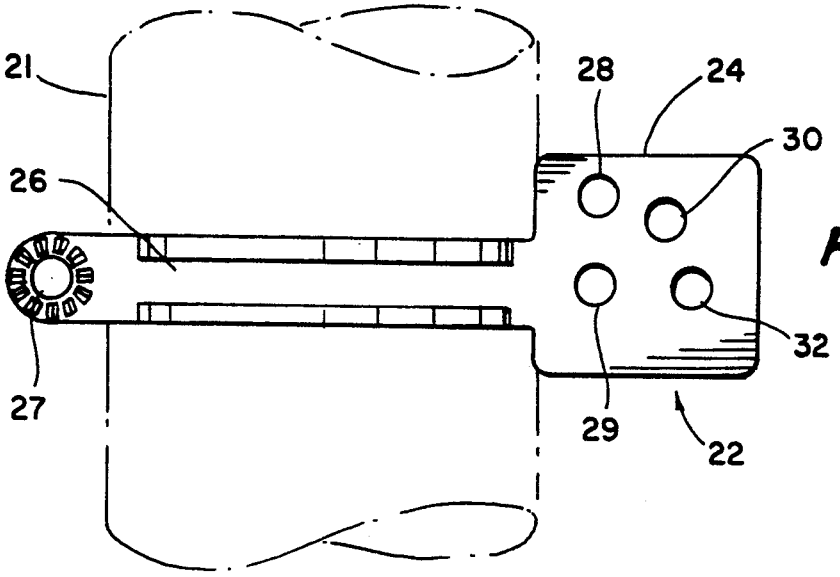
FIG. 2 is a top view of the grounding clamp according to a first embodiment of the present invention.

FIGS. 1A and 1B illustrate a typical metallic compression connector, such as lug 10, which is designed to be used with the present invention. This lug consists of a primarily rectangular mounting pad 12 provided with holes 14 and 16. An electrical cable or conduit is inserted into an opening provided at one end 18 of the compression lug 10. Once inserted, the compression lug is crimped at the portion 20 which is colored. A pedestal or transition portion 19 is provided between the mounting pad 12 and end 18. Although FIG. 1 illustrates a compression lug 10 provided with a single inked portion 20, it should be noted that if additional crimps are needed, a plurality of inked surfaces 20 will be included. Although the exact dimensions of this lug can be varied, it is noted that, for purposes of illustration, each hole 14,16 could be designed to accommodate $\frac{3}{8}''$ diameter bolts, and the centers of each hole are aligned and are separated by one inch.

Figure 3:
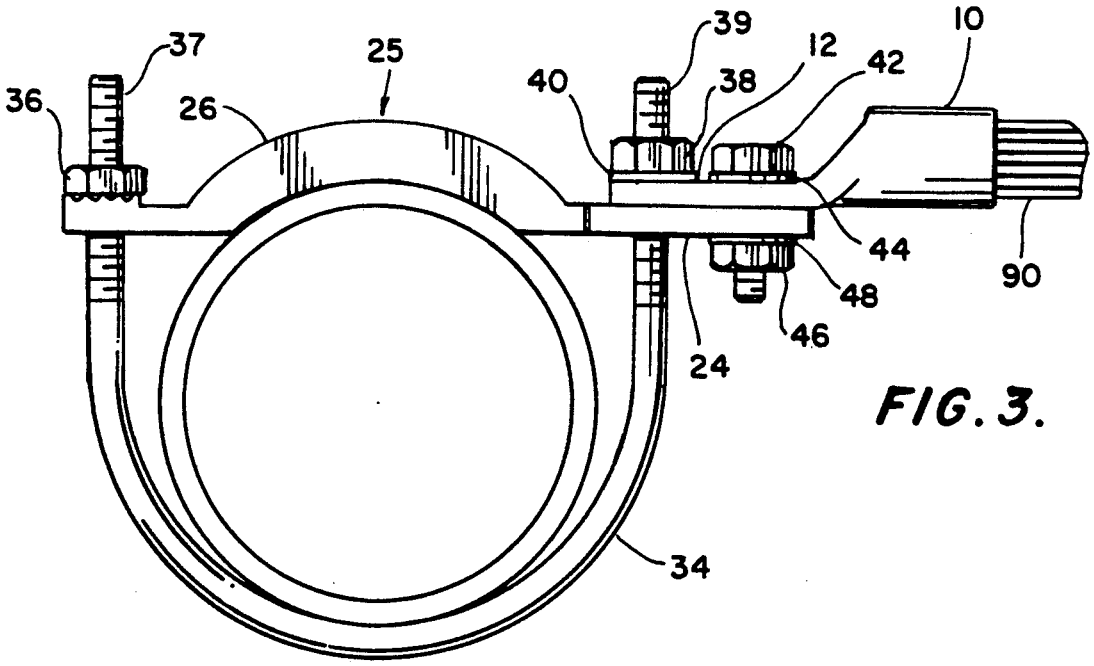
FIG. 3 is a side view of the grounding clamp according to a first embodiment of the present invention.

A first embodiment 25 of a grounding clamp 22 used to encircle a typical metallic pipe 21 is illustrated in FIGS. 2 and 3, with FIG. 3 also showing the compression lug. As shown in these figures, clamp 22 is provided with a mounting pad 24 directly connected to an arcuate saddle portion 26. A U-bolt 34 provided with threaded ends 37 and 39 is adapted to encircle the metallic pipe 21 and attach to a first hole 29 provided in the mounting pad 24 and a second hole 27 provided on the saddle portion 26, opposite to the mounting pad 24. Three additional holes 28, 30 and 32 are provided in the mounting pad 24 and are used to affix the compression lug 10 having the electrical cable 90 provided therein at various angles with respect to the pipe 21. A first nut 36 is used to affix one end of the U-bolt 34 to the saddle 26 through hole 27. A second nut 38 and washers 40 are used to affix the U-bolt 34 to the mounting pad 24 of the saddle 26 as well as the mounting pad 12 of the compression lug 10 through hole 29. A bolt 42 having a tightening hexagonal nut 46 and washers 44 and 48 are used to affix the compression lug 10 to the mounting pad 24 of the saddle 26 through hole 32 in one of several possible positions. As illustrated in FIG. 3, the compression lug 10 and electrical cable 90 are provided perpendicular to the metallic pipe 21. If the compression lug is secured through hole 28, the electrical cable 90 would be parallel to the metallic pipe 21. If, however, the compression lug is secured through hole 30, the cable 90 would extend at a 45° angle with respect to the pipe 21.

Although the exact materials used to construct the U-bolt 34 and the saddle 26 are not crucial, it has been found that the saddle can be manufactured from a cast high copper alloy, and the U-bolt manufactured from silicon bronze (DURIUM TM) hardware. This particular embodiment is designed to be utilized with metallic pipes having diameters from ½" up to approximately 6".

Figure 4:
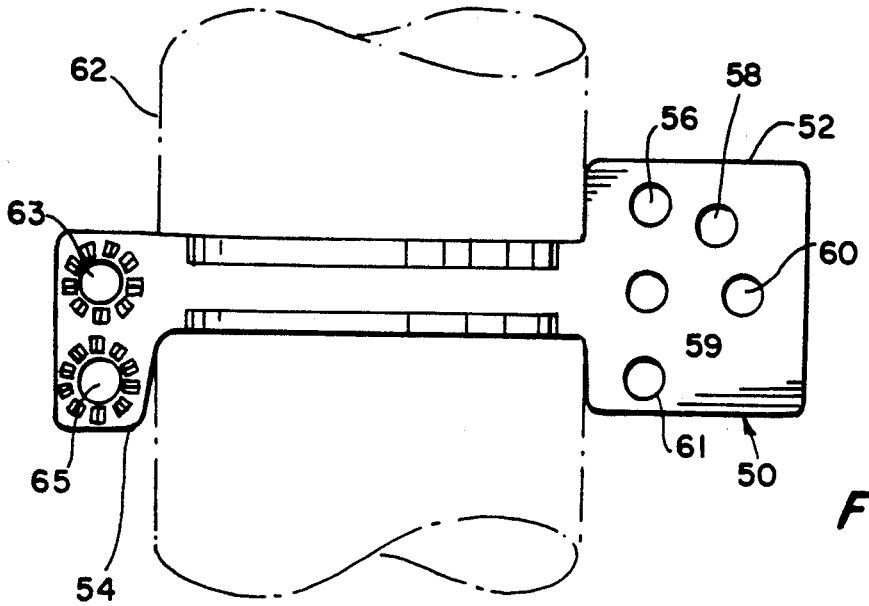
FIG. 4 is a top view of a grounding clamp according to a second embodiment of the present invention.
Figure 5:
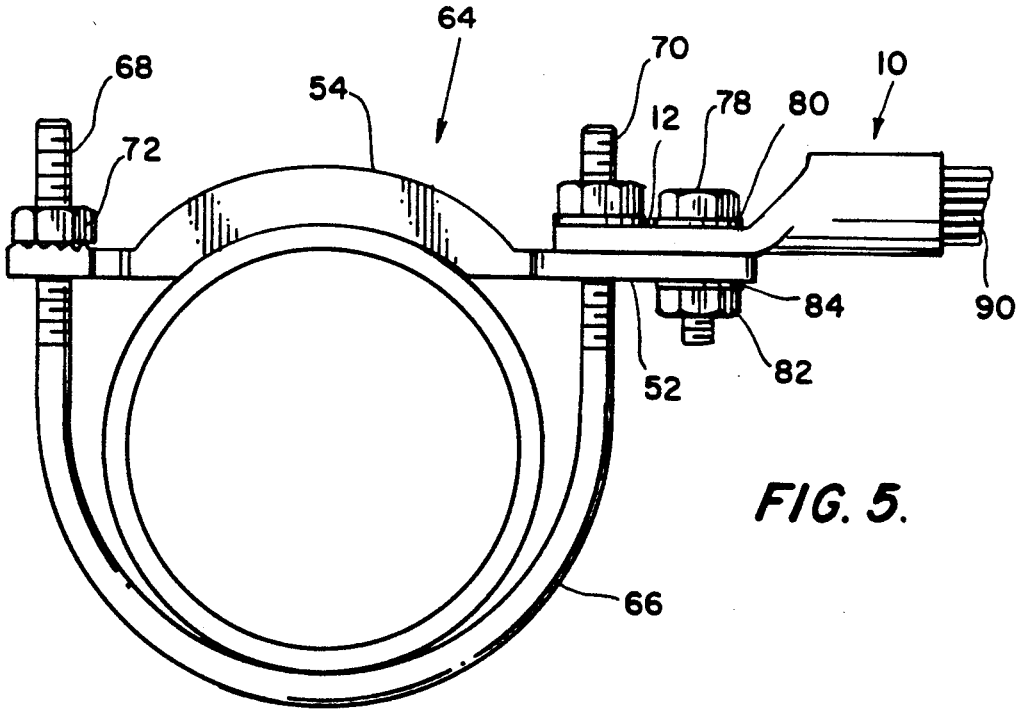
FIG. 5 is a side view of the grounding clamp according to a second embodiment of the present invention.

FIGS. 4 and 5 illustrate a second embodiment of the present invention for use with metallic pipes having diameters of approximately 8" to 12". As shown in these figures, a ground clamp 50 is provided with a mounting pad 52 and a saddle 54. The mounting pad 52 is provided with holes 56, 58 and 60 for the purpose of mounting the mounting pad 12 (shown in FIG. 1) thereon in various angular inclinations with respect to the pipe 62. Since the pipe 62 is much larger in diameter than the pipe 19 shown in FIGS. 2 and 3, two U-bolts are used to secure the saddle 54 to the pipe 62. One hole 59, along with hole 63 on saddle 54, is used to secure both one of these U-bolts as well as the mounting pad 12 of the compression lug 10 to the mounting pad 52 of the saddle 50. A second hole 61, in conjunction with hole 65, is used to secure the second U-bolt to the mounting pad 52 and the saddle 54. The first U-bolt 66 is illustrated in FIG. 5 and includes a first threaded end 68 secured to the mounting pad 52 by a nut 72, and a second threaded end 70 which is secured to both the mounting pad 52 of the saddle 54 as well as the mounting pad 12 of the lug 10 using a nut 74 and washer 76. The mounting pad 12 of the lug 10 is also secured to the mounting pad 52 of the saddle 54 utilizing bolt 78, hexagonal tightening nut 82 and washers 80 and 84. It is noted that FIG. 5 shows a second embodiment of the present invention in which only one of the U-bolts is installed. As was true with the embodiment shown in FIGS. 2 and 3, the cable 90 is perpendicular to the pipe 62.

Figure 6:
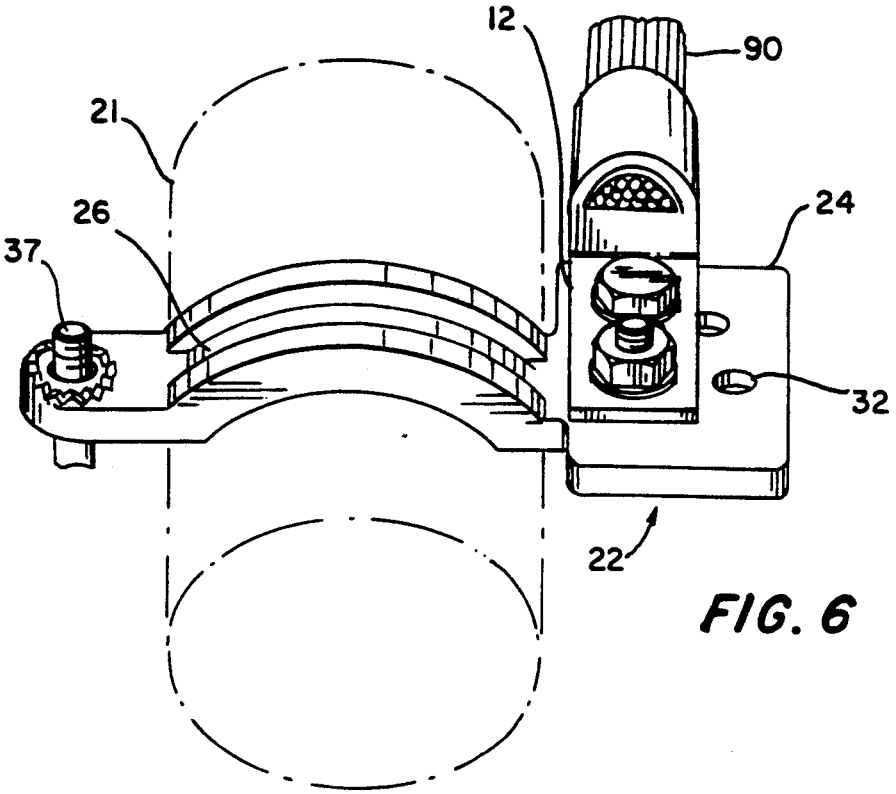
FIGS. 6 and 7 are top views of the present invention including the metallic pipe, grounding clamp and compression connector.
Figure 7:
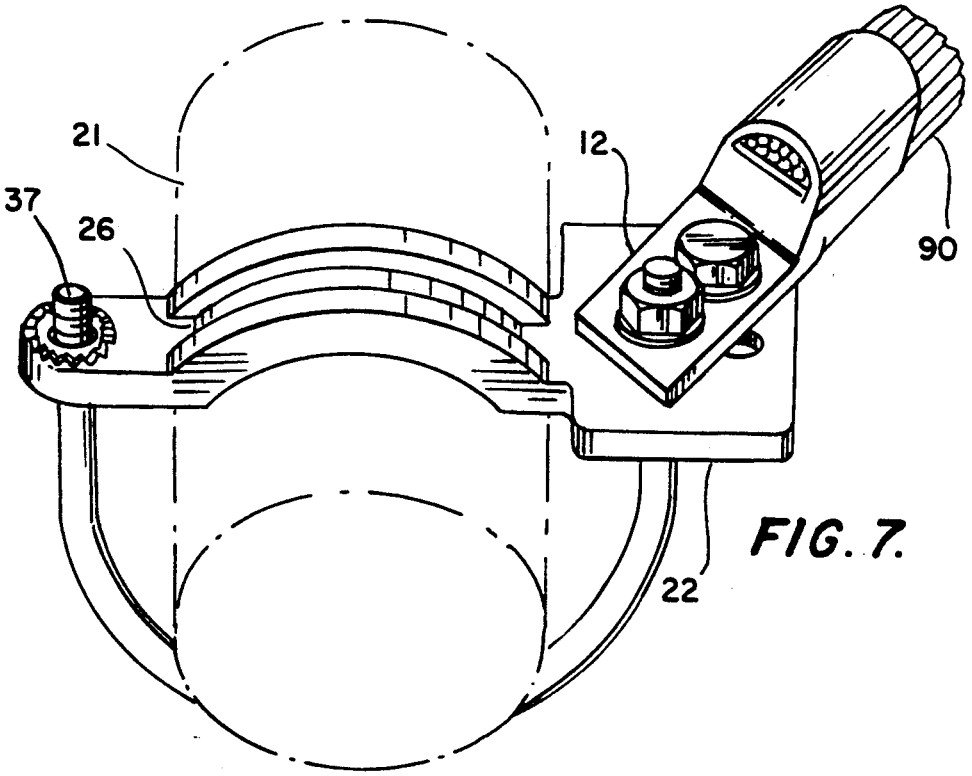

FIGS. 6 and 7 illustrate the first embodiment of the present invention in which the connecting lug is connected to the mounting pad of the saddle parallel with the metallic pipe (FIG. 6) and at a 45° angle with respect to the metallic pipe (FIG. 7).

In operation, the metallic surface of the pipe is prepared in a standard manner by shining the area which would be provided under the silicon bronze saddle contact area. The clamp saddle is then applied to this area and the U-bolt or bolts is/are tightened with a tightening torque of approximately 240"/lb. The perimeter of the saddle seat is sealed by applying an oxide inhibiting compound such as Burndy PENETROX-E® or the equivalent. Either prior to tightening the U-bolts, or after the U-bolts are applied, the electrical cable provided in the compression lug is crimped therein and then, using the appropriate bolt, hexagonal nut and washer combination, is applied directly to the mounting pad of the saddle.

Having now fully described the invention, it will be apparent to one of ordinary skill in the art that many changes and modifications can be made thereto without departing from the spirit or scope of the invention as set forth herein. For example, the present invention illustrates the compression lug parallel to the metallic pipe, perpendicular to the pipe or at a 45° angle with respect to the pipe. Obviously, the lug could be provided at any angle with respect to the pipe.

What is claimed is:

1. A system for grounding an electrical cable with a crimped compression connector to a cylindrical grounding electrode, comprising:

a grounding clamp encircling and abutting the grounding electrode, said grounding clamp provided with a first mounting pad having a plurality of holes therein and a U-bolt having first and second ends, a compression connector provided with an end section containing a portion of the crimped electrical cable therein, said compression connector provided with a connection section provided with a second mounting pad having a plurality of holes therein and a tapered transition section provided between said end section and said connection section; and connecting means for removably connecting the second mounting pad of said compression connector to the first mounting pad of said ground clamp, allowing said compression connector to be oriented at various discrete angles with respect to the grounding electrode, said connecting means including a first means for connecting one of said ends of said U-bolt through one of said plurality of holes of said first mounting pad and through one of said plurality of holes of said second mounting pad, and a second means for connecting said first mounting pad to said second mounting pad through a second of said plurality of holes of said first mounting pad and a second of said plurality of holes of said second mounting pad.

2. The system for grounding a crimped electrical cable in accordance with claim 1, wherein said grounding clamp consists of a saddle member directly connected to said first mounting pad and a single U-bolt encircling the grounding electrode and connected to said first mounting pad and said saddle member.

3. The system for grounding a crimped electrical cable of accordance with claim 2 wherein said single U-bolt is connected to both said first mounting pad and said second mounting pad.

4. The system for grounding a crimped electrical cable in accordance with claim 1, wherein said connecting means comprises a bolt connected between said first mounting pad and said second mounting and a plurality of holes provided on said first mounting pad.

5. The system in accordance with claim 1, wherein said first mounting pad is located to the side of the grounding electrode.

6. A system for grounding an electrical cable with a crimped compression connector to a metallic pipe, comprising:

a grounding clamp encircling and abutting the metallic pipe, said grounding clamp provided with a first mounting pad having a plurality of holes therein and a U-bolt having first and second ends;

a compression connector provided with an end section containing a portion of the crimped electrical cable therein, said compression connector provided with a connection section provided with a second mounting pad having a plurality of holes therein and a tapered transition section provided between said end section and said connection section; and connecting means for removably connecting the second mounting pad of said compression connector to the first mounting pad of said grounding clamp, allowing said compression connector to be oriented at various discrete angles with respect to the metallic pipe, said connecting means including a first means for connecting one of said ends of said U-bolt through one of said plurality of holes of said first mounting pad and through one of said plurality of holes of said second mounting pad, and a second means for connecting said first mounting pad to said second mounting pad through a second of said plurality of holes of said first mounting pad and a second of said plurality of holes of said second mounting pad.

7. The system for grounding a crimped electrical cable in accordance with claim 6, wherein said grounding clamp consists of a saddle member directly connected to said first mounting pad and a single U-bolt encircling the metallic pipe and connected to said first mounting pad and said saddle member.

8. The system for grounding a crimped electrical cable in accordance with claim 7 wherein said single U-bolt is connected to both said first mounting pad and said second mounting pad.

9. The system for grounding a crimped electrical cable in accordance with claim 6, wherein said connecting means comprises a bolt connected between said first mounting pad and said second mounting and a plurality of holes provided on said first mounting pad.

10. The system in accordance with claim 6, wherein said first mounting pad is located to the side of the metallic pipe.

11. A system for grounding an electrical cable with a crimped compression connector to a cylindrical grounding electrode, comprising:

a grounding clamp encircling and abutting the grounding electrode, said grounding clamp provided with a first mounting pad having a plurality of holes therein, said grounding clamp further including a saddle member directly connected to said first mounting pad, and first and second U-bolts encircling the grounding electrode and connected to said first mounting pad and said saddle member;

a compression connector containing a portion of the crimped electrical cable therein, said compression connector provided with a second mounting pad, having a plurality of holes therein; and connecting means for removably connecting the second mounting pad of said compression connector to the first mounting pad of said grounding clamp, allowing said compression connector to be oriented at various angles with respect to the grounding electrode.

12. A system for grounding an electrical cable with a crimped compression connector to a metallic pipe, comprising:

a grounding clamp encircling and abutting the metallic pipe, said grounding clamp provided with a first mounting pad having a plurlity of holes therein, said grounding clamp further including a saddle member directly connected to said first mounting pad, and first and second U-bolts encircling the metallic pipe and connected to said first mounting pad and said saddle member;

a compression connector containing a portion of the crimped electrical cable therein, said compression connector provided with a second mounting pad, having a plurality of holes therein; and connecting means for removably connecting the second mounting pad of said compression connector to the first mounting pad of said grounding clamp, allowing said compression connector to be oriented at various angles with respect to the metallic pipe.

* * * * *